United States Patent [19]

Fukuichi

[11] 4,091,611

[45] May 30, 1978

[54] DIGITAL ALARM WATCH

[75] Inventor: Takuro Fukuichi, Tokyo, Japan

[73] Assignee: Kabushiki Kaisha Daini Seikosha, Japan

[21] Appl. No.: 731,707

[22] Filed: Oct. 12, 1976

[30] Foreign Application Priority Data

Oct. 13, 1975 Japan ..... 50-123010
Oct. 13, 1975 Japan ..... 50-123012

[51] Int. Cl.[2] ..... G04C 21/00; G04B 19/30; G04B 23/12

[52] U.S. Cl. ..... 58/57.5; 58/38 R; 58/50 R

[58] Field of Search ..... 58/19 C, 21.11, 22.7, 58/38, 39.5, 50 R, 57.5, 152 B, 153, 19 R

[56] References Cited

U.S. PATENT DOCUMENTS

| | | | |
|---|---|---|---|
| 3,727,395 | 4/1973 | Baylor | 58/38 |
| 3,745,761 | 7/1973 | Tsuruishi | 58/38 |
| 3,898,790 | 8/1975 | Takamune et al. | 58/23 BA |
| 4,015,417 | 4/1977 | Kitai | 58/22.7 |

*Primary Examiner*—Edith S. Jackmon
*Attorney, Agent, or Firm*—Robert E. Burns; Emmanuel J. Lobato; Bruce L. Adams

[57] ABSTRACT

The invention provides a digital alarm watch comprising at least a time keeping circuit, an illuminating means and an alarm means, wherein the illuminating is adapted to be prevented from operating when the alarm means operates.

3 Claims, 2 Drawing Figures

DIGITAL ALARM WATCH

BACKGROUND OF THE INVENTION

The present invention relates to a digital electronic watch and more particularly to a digital electronic watch in which when an alarm means operates during the operation of an illuminating means, the illuminating means is adapted to be prevented from operating.

Conventionally, there have been employed various watches of the digital electronic type and none of them has means for preventing duplicate and simultaneous operation of the alarm means and illuminating means. Accordingly, the power consumption of the battery is enormously increased.

OBJECT OF THE INVENTION

The present invention aims to eliminate the above noted difficulty and insufficiency, wherein the object of the present invention is to provide a digital electronic watch such that when an alarm means operates during the operation of an illuminating means, the operation of the illuminating means is adapted to be stopped.

The other object of the present invention is to provide a digital alarm watch wherein when the alarm means operates, the illuminating means is adapted to be prevented from operating.

SUMMARY OF THE INVENTION

According to the present invention, there is provided a digital watch wherein when the alarm means operates, the illuminating is adapted to be prevented from operating.

BRIEF DESCRIPTION OF THE DRAWINGS

The above mentioned and further objects, features and advantages of the present invention will become more obvious from the following description when taken in connection with the accompanying drawings, which show preferred embodiments of the present invention and wherein.

DETAILED EXPLANATION OF THE INVENTION

This invention relates to a digital alarm watch and more particularly to such a watch including an alarm means which when operated during the operation of an illuminating means, the illuminating means is adapted to be prevented from operating.

Figure 1:
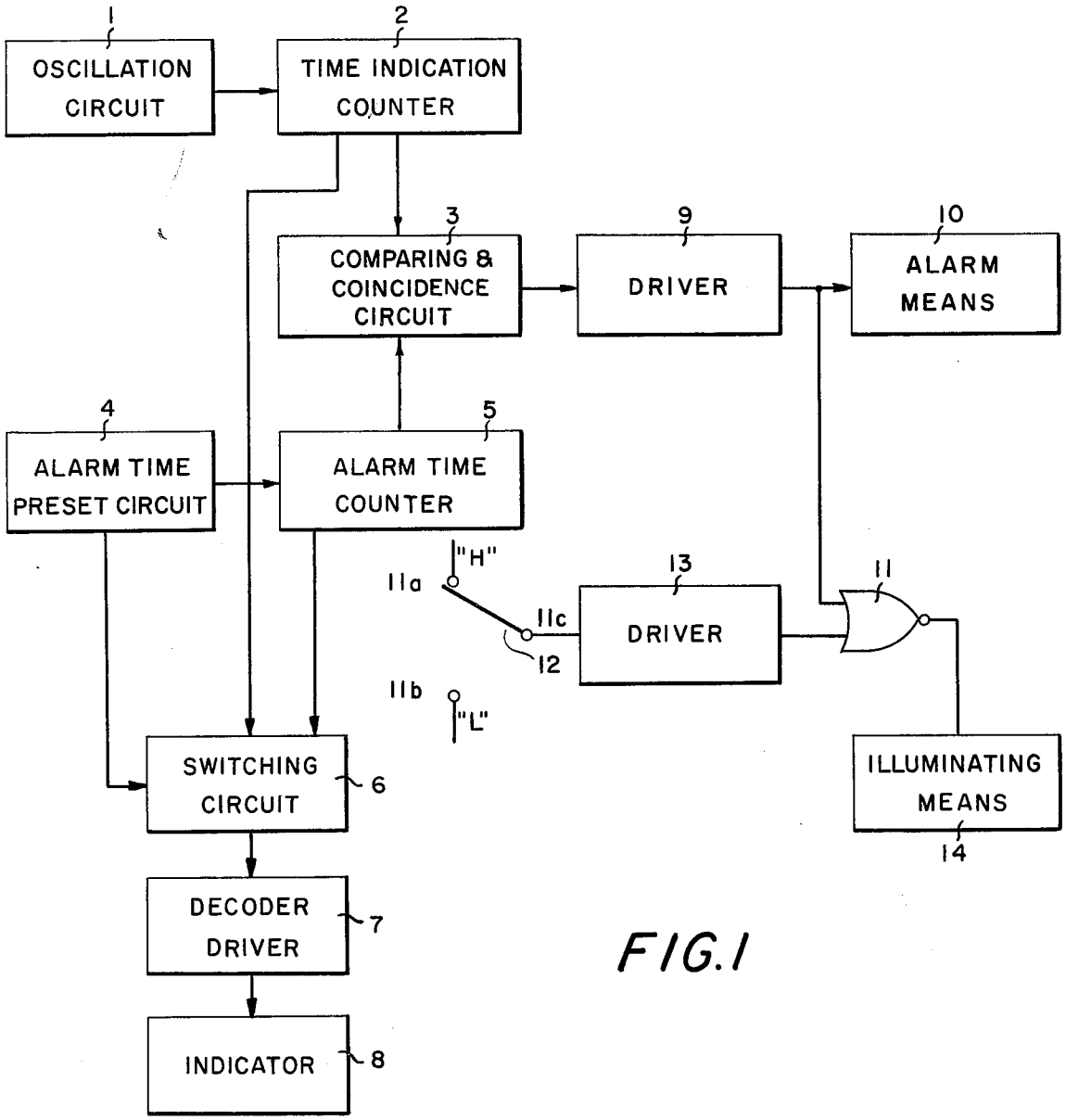
FIG. 1 shows a block diagram of the entire construction of a first embodiment of a digital electronic watch in accordance with this invention.

Referring now to the first embodiment of the present invention illustrated in of FIG. 1:

In the drawing, 1 denotes an oscillation circuit. A signal of this oscillation circuit is impressed on a comparing and coincidence circuit 3 through a time indicating counter 2.

A reference numeral 4 designates an alarm time preset circuit. An output signal of this preset circuit 4 is impressed on an alarm time counter 5 and an indication switching circuit 6 respectively and also output signal of the alarm time counter 5 is impressed on the comparing and coincidence circuit 3.

The output signal of the indication switching circuit 6 is transmitted to an indicator 8 through a decoder driver 7.

The output of the comparing and coincidence circuit 3 is transmitted to an alarm means 10 through a driver 9 and also impressed on one input terminal of a NOR circuit 11. On the other input terminal of the NOR circuit 11, the output signal of a controlling switch 12 is impressed through a driver 13. The output signal of the NOR circuit 11 is connected to an illuminating means 14 to illuminate an indication panel (not shown).

The operation of the digital alarm watch of the present invention provided with the aforementioned construction will be explained in detail hereinbelow.

The signal generated in the oscillation circuit 1 is counted by the time indication counter 2 for developing a count representative of time and suitable the time. In the alarm time preset circuit 4, any time for operating the alarm means 10 can be set or memorized. At this time, the indication switching circuit 6 transmits and indicates the content of the alarm time counter 5 to the indicator 8 through the decoder driver 7 in accordance with the signal from the alarm time preset circuit 4.

When the content of the alarm time counter 5 coincides with that of the time indication counter, a coincidence signal from the comparing and coincidence circuit 3 is transmitted to the alarm means 10 through a driver 9 and then said alarm means operates.

When the controlling switch is turned ON or placed at a high level "H", the driver 13 is turned ON and the signal "L" is developed at the driver output. Then, the signal is transmitted through the NOR circuit 11 so as to operate or light an illuminating means 14. When it is not required that the illuminating means be lit, the controlling switch is turned OFF or switched to low level "L" and then the light is shut off.

When the alarm means 10 is turned ON, that is to say, the driver 9 is turned ON, the alarm means 10 will operate even though the driver 13 becomes turned ON. Therefore even if the switch 12 is set to H, the NOR circuit is brought into the OFF condition, so that there is no possibility for simultaneous or duplicate operation of the alarm means 10 and the illuminating means 14.

According to the present invention, since a digital electronic watch has the aforementioned construction and mode of operation, and the duplicate operation of the alarm means and the illuminating means does not occur the watch circuit is not subjected to trouble due to an abnormal lowering of the capacity of the battery.

Figure 2:
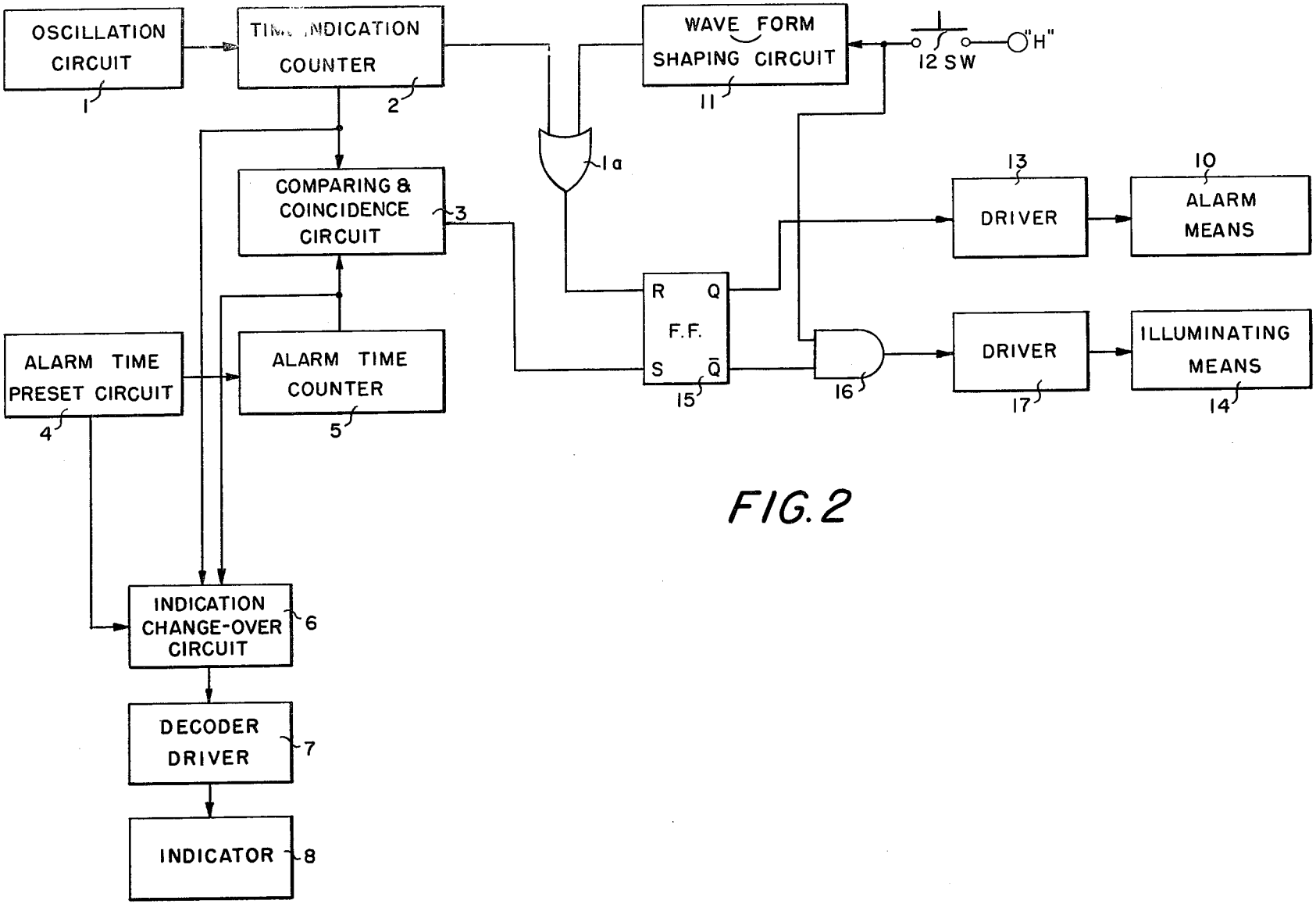
FIG. 2 shows a block diagram of the entire construction of a second embodiment of a digital electronic watch according to the present invention.

Referring now to the second embodiment of the present invention illustrated in FIG. 2:

In the drawing, reference numeral 1 designates an oscillation circuit. The output signal of this oscillation circuit 1 is impressed through a time indication counter 2 to a comparing and coincidence circuit 3 and at the same time, is impressed to one input terminal of OR circuit 1*a*.

The output signal of alarm time preset circuit designated by reference numeral 4 is impressed to an alarm time counter 5 as well as to an indication change-over circuit 6 and further connected through a decoder driver 7 to an indicator 8.

The output signal of a control switch 12 is impressed through a waveform shaping circuit 11 to the other input terminal of the OR circuit 1*a*. The output signal of the OR circuit 1*a* and that of the comparing and coincidence circuit 3 are respectively impressed to the R terminal and S terminal of RS flip-flop 15. The Q output of the RS flip-flop 15 is connected through a driver 13 to an alarm means 10.

The $\overline{Q}$ output of the RS flip-flop 15 is connected to one input terminal of AND circuit 16, while the output signal of the control switch 12 is impressed to the other input terminal of the AND circuit.

The output of the AND circuit 16 is connected through a driver 17 to an illuminating means 14.

In the operation of the digital electronic watch of the present invention having the aforesaid construction, the output of the oscillation circuit 1 can be counted in the time indication counter 2 so as to develop a count for time indication and presetting of alarming time be memorized in the alarm time counter 5.

At this time, contents of the alarm time counter 5 is impressed to the indicator 8 through the decoder driver 7 in accordance with a signal from the alarm time preset circuit 4 in response to the operation of the indication change-over circuit 6.

When it is not necessary to watch the alarm preset contents, the alarm time preset circuit 4 is turned OFF, whereby through the indication change-over circuit 6 the contents of the time indication counter 2 is impressed through the decoder driver on the indicator 8. Accordingly, normally, the time is indicated on the indicator, and if required, the preset contents of the alarm can be read.

When the contents of the alarm time counter 5 coincides with that of the time indication counter 2, the S terminal of RS flip-flop 15 is turned ON in response to the output signal from the comparing and coincidence circuit, output Q is brought to the "H" level, and the alarm means 10 is driven whereby the arrival of the preset time can be suggested for example through sound.

In this condition, a pulse signal from the time indication counter 2 permits a reset signal passes through the OR circuit 1a and is applied to the R terminal. Consequently, output $\overline{Q}$ is brought to the a "H" level, output Q to the "L" level, and the alarm means does not operate; for example, sound is stopped.

When the alarm means begins to operate and then it is necessary to stop immediately the operation of said alarm means, the control switch 12 is turned ON, and current will pass through the OR circuit 1a through the wave form shaping circuit 11. Consequently, the R terminal of the RS flip-flop 15 is brought into a ON condition and the driver 13 of the alarm means 10 into a OFF condition, whereby the operation of the alarm means can be stopped.

In case that the illuminating means 14 is required to be operated, the control switch 12 is turned ON and a pulse signal of "H" level is developed by the waveform shaping circuit. This pulse is effective to turn the reset terminal or R terminal of the RS flip-flop 15 ON and keep the output $\overline{Q}$ at the "H" level. This output $\overline{Q}$ is an input to one input terminal of AND circuit 16. The output of the AND circuit 16 is brought to the "H" level while the control switch 12 is turned ON, and the driver 17 is actuated to light an illuminating means 14.

However, when the arrival of the alarm preset time comes while the illuminating means 14 is lit, duplicate operation of the alarm means and the illuminating means is prevented in accordance with the below-mentioned mode of operation because of the large consumption of power when the alarm means operates simultaneously with the illuminating means.

While the illuminating means 14 is lit, the control switch 12 is closed to develop and a pulse signal of "H" level as an output from the waveform shaping circuit 11. The R terminal of the RS flip-flop is turned ON through the OR circuit 1a. The output $\overline{Q}$ is brought into a "H" level and the output Q into a "L" level.

At this time, when the arrival of the alarm preset time comes and an "H" level pulse coincidence signal is applied to the S terminal from the comparing and coincidence circuit 3, the output of the RS flip-flop 12 is inverted and the output Q is brought the "H" level, the output $\overline{Q}$ brought to the "L" level and the AND circuit 16 is closed. The driver 17 is turned OFF and the illuminating means 14 is extinguished.

Since the digital electronic watch of the present invention has the above-mentioned construction and operation, the alarm means and the illuminating means can not be operated simultaneously and the capacity of a battery can be normally maintained. Furthermore, sound of the alarm means can be kept.

What we claim is:

1. A digital alarm watch comprising, in combination: time standard circuit means for generating a repetitive signal which defines a time standard; time counter means connected to receive the repetitive signal for counting the same to develop a cumulative count representation of time; alarm time circuit means for storing a signal representative of a time that an alarm signal is to be emitted; comparing and coincidence circuit means connected to receive the cumulative count of said time counter means and the signal stored in said alarm time circuit means for comparing the same and for developing an output signal when the count of said time counter means and the stored signal of said alarm time circuit means coincide; display means for displaying selectively the time represented by the count of said time counter means and the time represented by the signal stored in said alarm time circuit means; alarm means enabled by the output signal of said comparing and coincidence circuit means for emitting an alarm signal when enabled; illuminating means enabled by a control signal for emitting light when enabled; and control circuit means responsive to an input signal for applying the output signal of said comparing and coincidence circuit means to said alarm means for enabling said alarm means, and for applying an enabling signal to said illuminating means in response to the input signal of said control circuit means when no output signal is developed by said comparing and coincidence circuit means, and for interrupting an enabling signal applied to said illuminating means when said comparing and coincidence circuit means develops an output signal during application of an input signal to said control circuit means to prevent said alarm means and said illuminating means from being simultaneously enabled, and to disenable said illuminating means when said alarm means is enabled.

2. A digital alarm watch according to claim 1, wherein said control circuit means comprises an OR gate; a flip-flop having a first input connected to receive the output signal of said comparing and coincidence circuit means and having a second input connected to receive the input signal of said control circuit means through said OR gate; and an AND gate having a first input connected to receive an output of said flip-flop and having a second input connected to receive the input signal of said control circuit means, wherein said AND gate develops the enabling signal for said illuminating means.

3. A digital alarm watch according to claim 1, wherein said control circuit means comprises a NOR gate; means for applying the output signal of said comparing and coincidence circuit means to a first input of said NOR gate; and means for applying the input signal of said control circuit means to a second input of said NOR gate, wherein said NOR gate develops the enabling signal for said illuminating means.

* * * * *